US007183673B2

(12) United States Patent
Dinn et al.

(10) Patent No.: US 7,183,673 B2
(45) Date of Patent: Feb. 27, 2007

(54) PASSIVE INDUCTIVE SWITCH

(75) Inventors: Don Dinn, Dartmouth (CA); Paul Wrathall, Musquodoboit Harbour (CA)

(73) Assignee: Magneto-Inductive Systems Limited, Nova Scotia (CA)

( * ) Notice: Subject to any disclaimer, the term of this patent is extended or adjusted under 35 U.S.C. 154(b) by 407 days.

(21) Appl. No.: 10/715,310

(22) Filed: Nov. 17, 2003

(65) Prior Publication Data

US 2004/0196605 A1 Oct. 7, 2004

(30) Foreign Application Priority Data

Apr. 2, 2003 (CA) ..... 2418387

(51) Int. Cl.
*H01H 47/00* (2006.01)
*F42C 11/00* (2006.01)

(52) U.S. Cl. ..... 307/139; 102/426; 102/427

(58) Field of Classification Search ..... 307/139; 102/426, 427

See application file for complete search history.

(56) References Cited

U.S. PATENT DOCUMENTS 3,621,290 A * 11/1971 Fryer ..... 327/214
3,884,170 A * 5/1975 Jensen ..... 114/20.1
4,685,396 A * 8/1987 Birse et al. ..... 102/506
5,621,412 A * 4/1997 Sharpe et al. ..... 340/10.33
6,011,439 A * 1/2000 Colarossi et al. ..... 330/290
6,236,333 B1 * 5/2001 King ..... 340/5.61
6,253,679 B1 * 7/2001 Woodall et al. ..... 102/221

* cited by examiner

*Primary Examiner*—Anatoly Vortman
*Assistant Examiner*—Michael Rutlend-Wallis
(74) *Attorney, Agent, or Firm*—Wood, Phillips, Katz, Clark & Mortimer

(57) ABSTRACT

A passive inductive switch for coupling a battery to a load in a remotely deployed battery-powered electronic device. The switch operates in response to a transmitted magnetic field at a particular frequency. The switch includes an antenna for transforming the magnetic field into an induced voltage and a voltage detector for sensing the induced voltage and triggering a switching element. The switch operates in a standby mode until a sufficient voltage is induced in the antenna which causes the switch to couple the battery to the load. In the standby mode the switch draws a negligible amount of power, which permits the device to be deployed in the field for long periods of time without expending significant battery power.

33 Claims, 5 Drawing Sheets

PASSIVE INDUCTIVE SWITCH

FIELD OF INVENTION

The present invention relates generally to switches, and more particularly to a switch triggered through induction by an AC magnetic field.

BACKGROUND OF THE INVENTION

There are many instances in which it is necessary or desirable to deploy a battery-powered electronic device into a remote field location. For example, in a military context, electronic devices may be deployed into a combat area that is difficult or dangerous to access. These devices may not be actively needed for months or years, and will therefore spend long periods in a standby mode. Accordingly, the devices need to be able to retain the ability to operate upon command without having lost significant battery power while in standby mode. Achieving this ability may present a problem since the electronics typically draw non-negligible current from the battery while in standby mode, thereby prematurely draining the battery and causing the device to have a short lifespan.

One approach to this problem is to power the devices other than through a battery, such as through transmitting electromagnetic energy to the device in order to activate and power it. Such a solution is found in typical radio frequency identification (RFID) systems. Unfortunately, this solution fails to adequately address the problem of transmitting electromagnetic power to devices in difficult operating environments, such as underwater, underground or in dense urban environments, where electromagnetic waves suffer from reflection, refraction or scattering. This approach also faces the difficulty of transmitting sufficient electromagnetic power to energize a device having moderately large power consumption in the active mode. Another shortcoming encountered with the electromagnetic wave approach, particularly in a military context, is the fact that significant electromagnetic transmissions may be easily detectable by opposing forces.

SUMMARY OF THE INVENTION

The present invention provides a circuit for coupling an electronic device to a battery in response to a detected magnetic field, while drawing little current when awaiting activation.

In one aspect, the present invention provides a passive inductive switch for coupling a battery to a load in a deployed device. The switch senses and responds to the transmission of an appropriate AC magnetic field produced by a magneto-inductive transmitter. The switch includes a magnetic field detector and a switching mechanism that responds to the detector's sensing of a particular magnetic field having an intensity above a predetermined threshold level. Both the magnetic field detector and the switching mechanism consume a negligible amount of power, meaning that the battery is not subjected to significant current drain while in standby mode since the load is not coupled to the terminals of the battery until the device is activated.

In another aspect, the present invention provides a circuit for coupling a battery to a load, the circuit including a magnetic field detector, the detector generating an output signal in response to the detection of a magnetic field and a switch element coupled in series with the battery and the load, the switch element being responsive to the output signal to couple the battery to the load.

In a further aspect, the present invention provides a circuit for coupling a battery to a load, the circuit including a magnetic field detecting mechanism for detecting the presence of a magnetic field and creating an output signal in response to the detection of the magnetic field, and a switch responsive to the output signal for coupling the battery to the load.

Other aspects and features of the present invention will become apparent to those ordinarily skilled in the art upon review of the following description of specific embodiments of the invention in conjunction with the accompanying figures.

BRIEF DESCRIPTION OF THE FIGURES

Reference will now be made, by way of example, to the accompanying drawings which show embodiments of the present invention, and in which.

DETAILED DESCRIPTION OF AN EMBODIMENT

Figure 1:
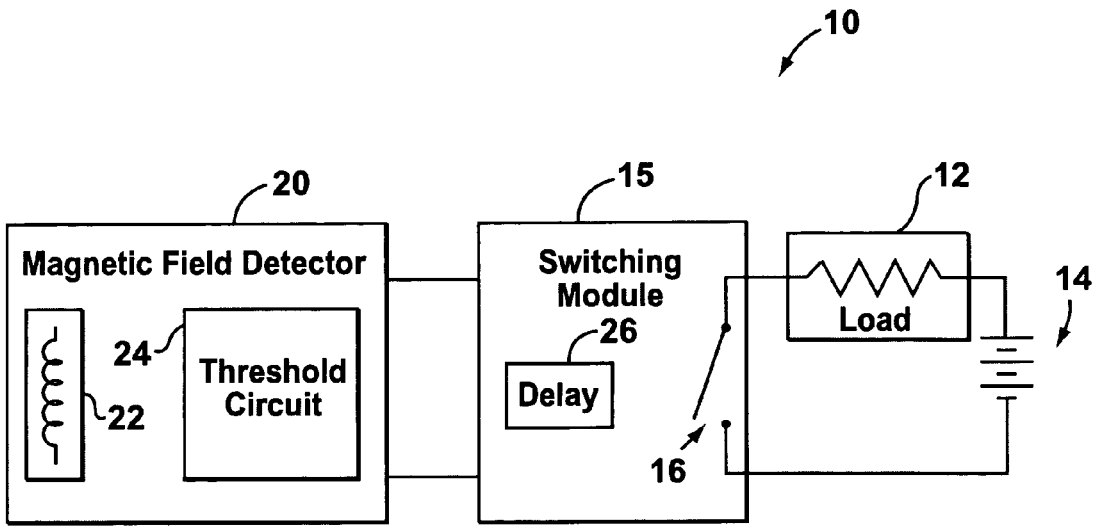
FIG. 1 shows in block diagram form an embodiment of a device according to the present invention.

Reference is first made to FIG. 1, which shows in block diagram form an embodiment of a device 10 according to the present invention. The device 10 includes a load 12 which is coupled to a battery 14. The device 10 further includes a switching module 15 having a switch 16 in series with the load 12 and the battery 14, such that when the switch 16 is closed, the battery 14 supplies power to the load 12.

A magnetic field detector 20 is also included in the device 10. The switch 16 operates in response to the magnetic field detector 20. When the magnetic field detector 20 senses the presence of a magnetic field, it causes the switch 16 to close, thereby coupling the battery 14 to the load 12. The magnetic field detector 20 is appropriately tuned to respond to a magnetic field at a particular predetermined frequency.

The magnetic field detector 20 includes an antenna 22 for sensing the magnetic field and a threshold circuit 24 for determining whether the strength of the sensed magnetic field meets or exceeds a threshold, in which case the switch 16 will be activated.

The switching module 15 may include a delay element 26 for preventing transient magnetic field signals from triggering the switch 16. The delay element 26 may also, or alternatively, be incorporated into the threshold circuit 24, or implemented through other suitable circuitry.

In operation, because the magnetic field detector 20 and the switching module 15 consume little or no power when in standby mode, the battery 14 will not be required to deliver any significant power until the device 10 is activated. The device 10 is activated when it receives a transmission of a moderately large AC magnetic field at the predetermined frequency for a predetermined time duration. The field induces a voltage in the antenna 22 (which may comprise a tuned antenna) that is sensed by the threshold circuit 24. If the induced voltage reaches a certain threshold, i.e. if the magnetic field strength is sufficient, the magnetic field detector 20 activates the switch 16, thereby coupling the load 12 to the battery 14.

This arrangement allows the device 10 to be deployed in the field for long periods of time despite the fact that the load 12 is to be powered by the battery 14 or by another separate battery. This is advantageous when the device 10 is deployed in locations that are difficult to physically access and/or are difficult to reach with conventional electromagnetic waves, such as underground or underwater installations.

The load 12 may include any electronic device, such as a receiver, a transceiver, or other devices that may be deployed in the field awaiting activation at an appropriate instance. For example, in one military-related application, the load 12 could be the activation electronics for indiscriminant weaponry, such as buried or surface landmines. The present invention permits a landmine or other explosive device to be deployed in the field and activated only when a magneto-inductive transmitter energizes the antenna 22 with the appropriate magnetic field to switch on the explosive device. The tuning of the antenna 22 to a particular frequency affords significant control over the activation of the device.

According to one aspect, the present invention utilizes low frequency, i.e. quasi-static, AC magnetic fields. A quasi-static magnetic field differs from an electromagnetic field in that the electric field component is negligibly small. A transmitter for quasi-static magnetic fields may be designed with a low-frequency excitation current to prevent creation of a significant electric field component. A quasi-static magnetic field does not propagate as an electromagnetic wave, but instead arises through induction. Accordingly, a quasi-static magnetic field is not subject to the same problems of reflection, refraction or scattering that radio frequency electromagnetic waves suffer from, and may thus communicate through various media (e.g. earth, air, Water, ice, etc.) or medium boundaries. Technology employing quasi-static AC magnetic fields can be referred to as 'magneto-inductive' technology.

Figure 2:
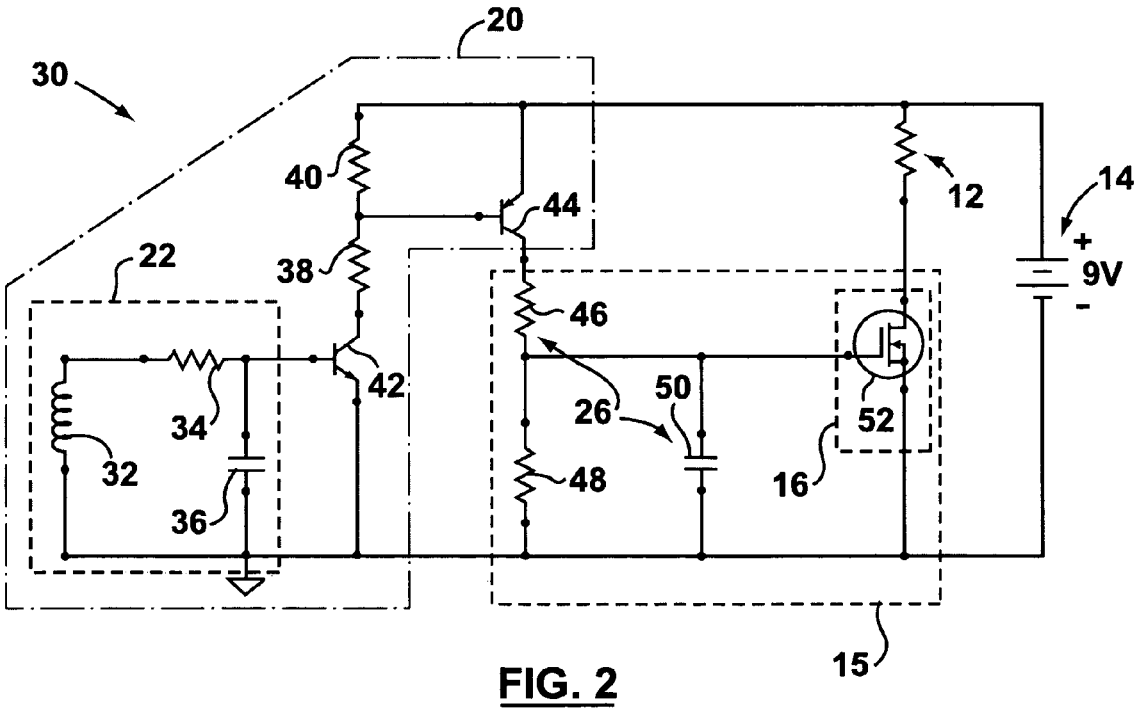
FIG. 2 shows an embodiment of a circuit according to the present invention.

Reference is now made to FIG. 2, which shows an embodiment of a circuit 30 according to the present invention. The circuit 30 is an implementation of the magnetic field detector 20 and the switching module 15, described above with reference to FIG. 1. The circuit 30 is configured for selectively coupling the load 12 to the battery 14 in response to an appropriate magneto-inductive transmission.

The circuit 30 includes the antenna 22, which is implemented as an induction coil 32 connected in parallel with a tuning capacitor 36. The induction coil 32 and the tuning capacitor 36 are arranged as a "tank circuit" having a natural resonant frequency determined by their component values. Also shown in series with the induction coil 32 is a resistor 34, which represents the sum of all the resistive components associated with the coil impedance. The induction coil 32 may be either a cored solenoid or a coil of wire. The windings of the induction coil 32 experience an induced electromotive force when subjected to an AC magnetic flux. As will be understood by those of ordinary skill in the art, the induced electromotive force resulting from a uniform AC flux density can be calculated from basic physics. Those of ordinary skill in the art will also appreciate that the AC flux density is an inverse function of the distance from the transmitter, and may be calculated with reference to basic physics.

If the antenna 22 is tuned by placing the tuning capacitor 36 in parallel with the coil 32, the induced electromotive force at the tuned frequency is enhanced by such tuning. The voltage available from the tuned antenna 22 in an AC magnetic field is readily calculable by one of ordinary skill in the art.

Under normal circumstances, the received signal from the antenna 22 is detected using amplifiers and energy supplied by a receiver power supply or batteries. However, the device 10 relies upon the transmitted magnetic field to induce sufficient voltage in the induction coil to trigger a switch that operates at standby power levels of 30 to 100 nanowatts or lower. It has been found that practical magneto-inductive transmitters can induce sufficient voltage in an appropriate coil to trigger the switch at operationally useful distances, e.g. at least 10 meters and, in at least one embodiment, over 100 meters. In addition, the AC magnetic field can penetrate structures, earth, and water which would be practically impervious to radio signals.

Referring still to FIG. 2, the magnetic field detector 20 in the circuit 30 further includes a rectifying amplifier comprising a transistor 42 with its base coupled to one end of the induction coil 32 and to one end of the tuning capacitor 36. The other end of the tuning capacitor 36, the other end of the induction coil 32, and the emitter of the transistor 42 are all connected to the negative terminal of the battery 14. In one embodiment, the transistor 42 is a medium to high-beta NPN bipolar junction transistor (BJT). The base-emitter junction of the transistor 42 is, therefore, coupled across the antenna 22, and it operates as a rectifying amplifier having a threshold operating voltage.

When a sufficiently large quasi-static magnetic field induces a significant voltage in the antenna 22, an adequate base current $I_b$ is created to enable operation of the transistor 42. In order to inject base current $I_b$ into the transistor 42, the transistor 42 must be forward biased by application of an adequate voltage $V_{be}$ across the base-emitter junction. The relationship between base current $I_b$ and the base-emitter voltage $V_{be}$ is given by the p-n junction equation:

$$I_b = I_o e^{-V_{be}/V_t} \tag{4}$$

where $I_o$ is the material saturation current and $V_t$ is a temperature dependent voltage that varies according to the type of semiconductor materials used in the transistor. For typical semiconductors, at room temperature, $V_t$ is nominally 0.026 volts and has a temperature coefficient of approximately −2 mV/° C.

The base-emitter junction of the transistor 42 functions as a rectifier, using just the positive half cycle of the antenna 22 voltage. In addition, the necessity of applying a sufficient voltage to forward bias the base-emitter junction serves as a voltage threshold, imposing a voltage input condition below which the induced voltage will not cause the circuit 30 to operate.

The output voltage from the antenna 22 is an approximately sinusoidal AC wave having a high-value source impedance determined by the values of the induction coil 32, the resistor 26, and the capacitor 36, meaning that only a small current is available to operate the base of the transistor 42. The resulting collector current $I_c$ is determined by the base current $I_b$ amplified by the current-gain factor $h_{FE}$ for the BJT. The transistor 42 is selected to be a type having a high enough current-gain factor $h_{FE}$ to enable the magnetic field to be detected despite a low induced voltage and low base current $I_b$.

The collector of the transistor 42 is coupled to the base of another transistor 44 in the circuit for the magnetic field detector 20, through a resistor 38, which functions to control the available current. The resistor 38 is provided to prevent the possibility of excessive current flowing into the collector and damaging the transistor 42. The second transistor 44 is a PNP BJT with its emitter coupled to the positive terminal of the battery 14. A high-valued leakage current resistor 40 is coupled across the base-emitter junction of the second transistor 42 to provide a path for small leakage currents. It may only be needed in high temperature operations and could be eliminated in some embodiments.

The first and second transistors 42 and 44 in combination provide a high gain amplification of the rectified antenna 22 current. For example, a base current of 100 nA in the first transistor 42 could generate a collector current in the second transistor 44 of several tens to hundreds of microamperes. This level of current is sufficient to operate a low- or high-power electronic switch via an integrating delay circuit, such that after a prescribed delay, a threshold is exceeded and the electronic switch is activated.

The collector of the second transistor 44 is connected to a resistor 46 in the circuit for the switching module 15 and the resistor 46 is connected at its other end with a capacitor 50. The other end of the capacitor 50 is connected to the negative battery 14 terminal. The capacitor 50, the resistor 46, and the collector current of the second transistor 44 together determine the time delay for the triggering of the switch 16. They may be selected so as to obtain an appropriate integrating delay to reject transient energy that lacks the duration desired to trigger active operation of the circuit 30. A discharge resistor 48 is coupled in parallel with the capacitor 50 to allow for the discharge of the capacitor 50 once the circuit 30 ceases to receive a sufficient magnetic field transmission.

The switch 16 for the circuit 30 may be chosen to suit the characteristics of the particular load 12 and the power supply. The switch 16 may operate from a separate power supply. In the embodiment shown in FIG. 2, the switch 16 comprises an N-channel MOSFET 52. The MOSFET 52 has its gate connected to the capacitor 50 and the output resistor 46. Its source and drain are coupled to the negative battery 14 terminal and the load 12, respectively. Operation at power supply voltage as low as approximately 3V is possible using the appropriate MOSFET 52. In some embodiments, the magnetic field detector 20 and the switching module 15 operate from a separate battery from the battery used to power the load 12.

In operation, when the first and second transistors 42 and 44 begin to conduct in response to an induced sinusoidal voltage in the antenna 22, the output current drawn by the second transistor 44 will appear in periodic pulses corresponding to the portion of the sinusoidal induced voltage above the threshold voltage. These pulses are averaged or integrated by the resistor 46 and the capacitor 50. In accordance with the time constant established by those two components, the capacitor 50 is charged by the current flowing through the resistor 46. When the voltage across the capacitor 50 reaches a predetermined threshold (as established by the switch 16), the switch 16 permits current flow from the load 12 to the negative terminal of the battery 14, thereby coupling the battery 14 to the load 12.

When the base current at the first transistor 42 is insufficient to activate the circuit 30, the only drain upon the battery 14 is the transistor leakage current. The leakage current of a suitable MOSFET 52 and of small-signal silicon BJTs can typically be less than 3 nA. On this basis, the circuit 30 will consume negligible energy from the battery 14 when in standby mode, and useful life of the battery is barely affected by the circuit 30 while in standby mode. In an embodiment for switching high voltage and high current loads, power to the load may be switched using a relay having no practical leakage current, wherein the relay is the load 12 driven by the MOSFET 52.

Figure 3:
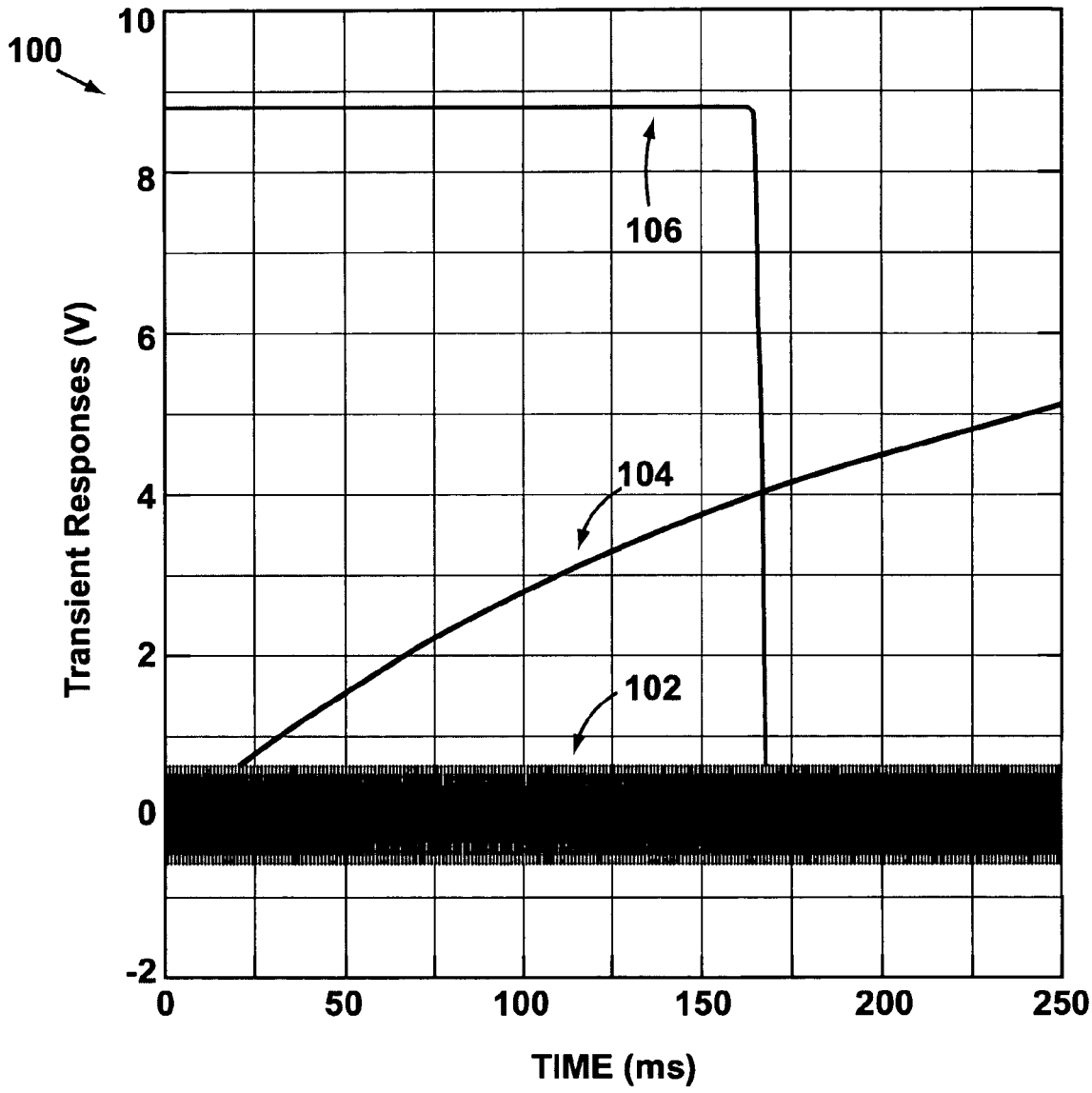
FIG. 3 shows a graph of various voltage waveforms for the circuit of FIG. 2.
Figure 4:
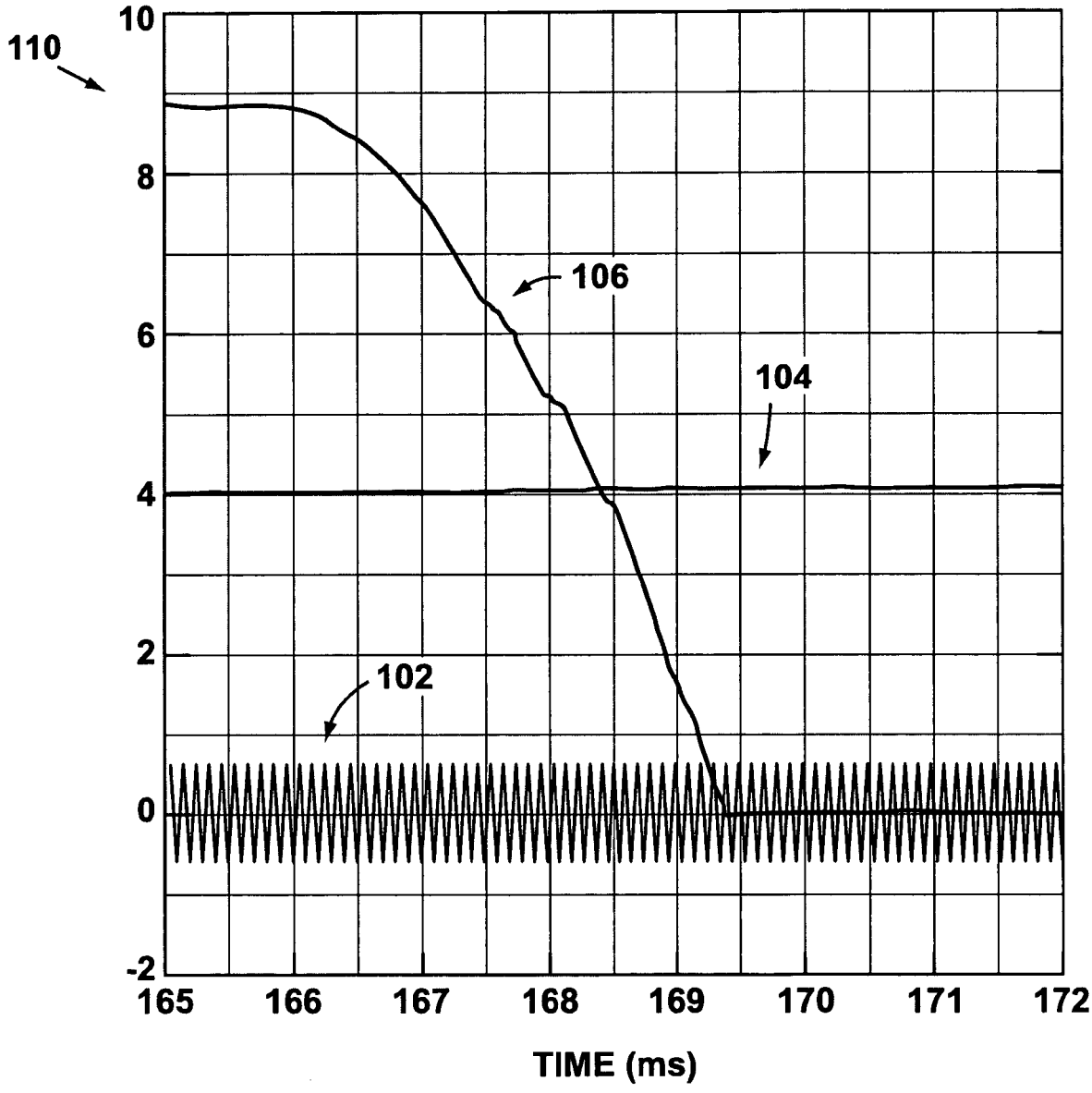
FIG. 4 shows an enlargement of a portion of the graph of FIG. 3.

Reference is now made to FIG. 3, which depicts a graph 100 of various voltages within the circuit 30 (FIG. 2) over time, and FIG. 4, which depicts a graph 110 that is an enlargement of a portion of FIG. 3.

Represented in the graphs 100, 110 is an input voltage waveform 102 indicating the output voltage of the antenna 22 (FIG. 2), as measured at the base of the first transistor 42 (FIG. 2). The input voltage waveform 102 results from reception of a magnetic field at a frequency of approximately 10 kHz. The frequency of oscillations renders the periodicity of the input voltage waveform 102 difficult to discern on the graph 100.

Also shown in the graphs 100, 110 is an output voltage waveform 104 indicating the voltage produced by the integrating delay portion of the circuit 30, as measured at the gate of the MOSFET 52 (FIG. 2). This output voltage waveform 104 increases in accordance with the time constant established by the resistor 46 (FIG. 2) and the capacitor 50 (FIG. 2), and reflects the charging of the capacitor 50.

The third waveform shown in the graphs 100, 110 is a switch voltage waveform 106, indicating the drain-to-source voltage across the MOSFET 52. This voltage is initially approximately 8.8 Volts, assuming a 8.8 Volt battery 14 (FIG. 2). Accordingly, no current flows in the load 12 (FIG. 2). Once the gate voltage at the MOSFET 52 reaches a predetermined threshold, which in this example is 4 Volts, the MOSFET 52 couples the load 12 to the negative battery 14 terminal. Therefore, the drain-to-source voltage shown in the switch voltage waveform 106 drops to near zero as the drain-to-source resistance drops to a low value.

Figure 5:
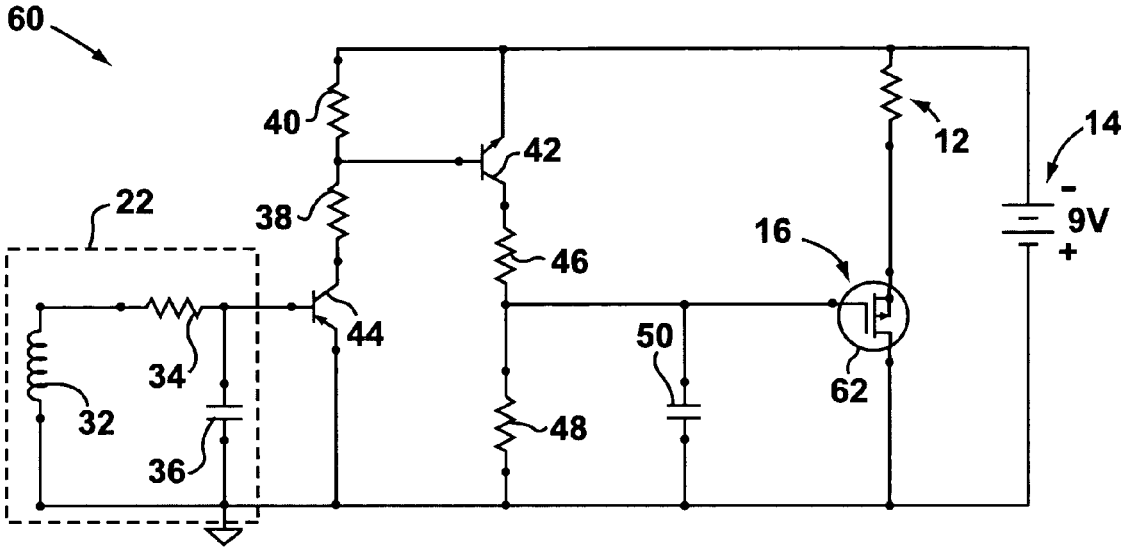
FIG. 5 shows another embodiment of a circuit according to the present invention.

Reference is now made to FIG. 5, which shows another embodiment of a circuit 60 according to the present invention. The circuit 60 shown in FIG. 5 differs from the circuit 30 shown in FIG. 2 only in that the polarity of all transistors 42, 44 are reversed as compared to circuit 30, the battery 14 is reversed in polarity, and the switch 16 is a P-channel MOSFET 62. Other components are the same as in circuit 30. The alternative circuit 60 operates in a similar manner as circuit 30, but with reversed current flows and voltage polarities.

Figure 6:
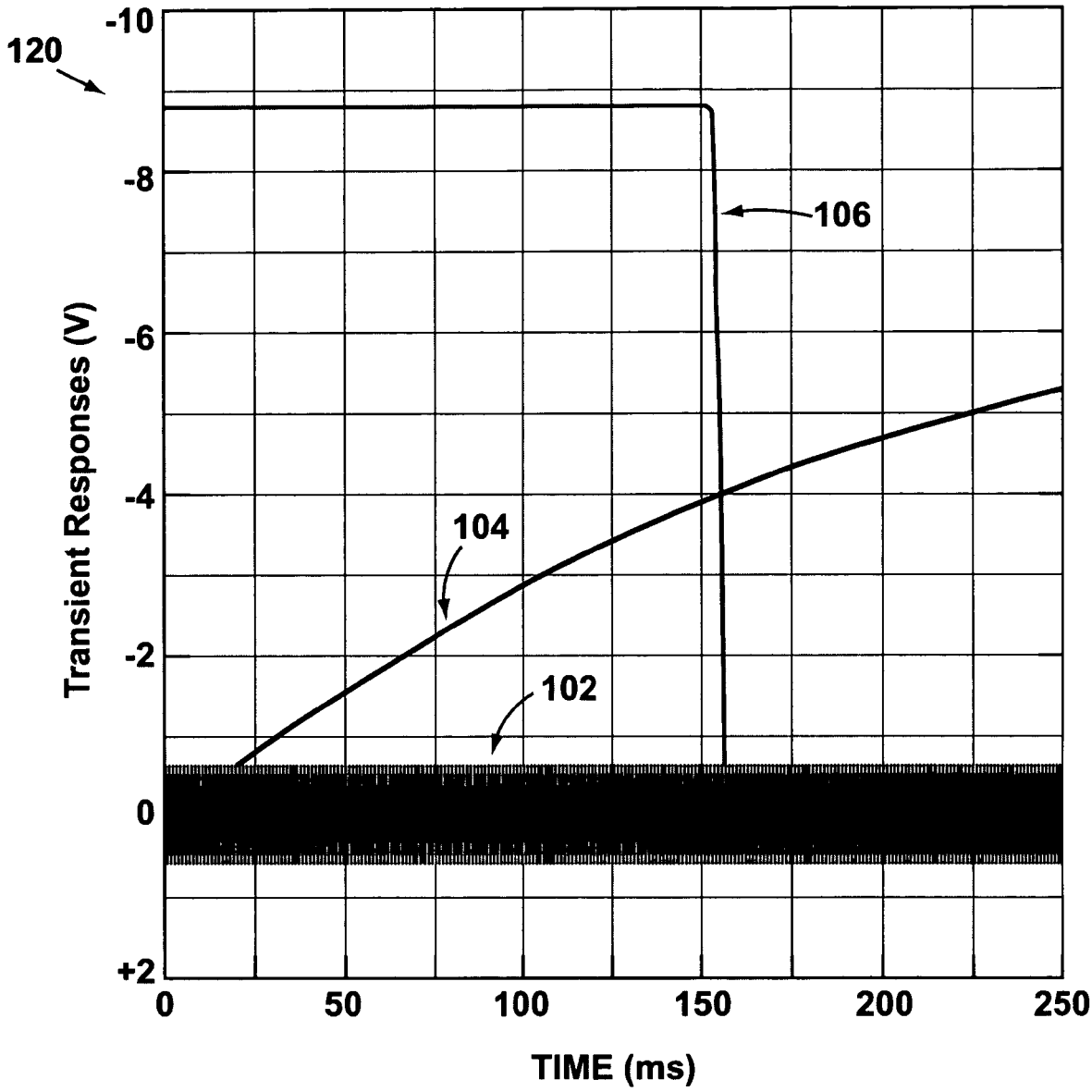
FIG. 6, shows a graph of various voltage waveforms for the circuit of FIG. 5.

A graph 120 of various circuit 60 voltage waveforms is shown in FIG. 6. As with FIG. 3, the graph 120 shows the input voltage waveform 102, the output voltage waveform 104 and the switch voltage waveform 106. Note the similar response characteristic to the graph 100 in FIG. 3.

Although the present invention has been described in terms of specific circuit embodiments having particular discrete components, those of ordinary skill in the art will appreciate that various alternative components or circuit arrangements may be utilized while still providing for a passive inductive switch according to the present invention. For example, any type of electronic switch, including a MOSFET, BJT or electronic switch, e.g. a relay, may be used in place of or in combination with the MOSFET 52, depending upon the extent to which the switch needs to handle high-power loads.

The present invention may be embodied in other specific forms without departing from the spirit or essential characteristics thereof. Certain adaptations and modifications of the invention will be obvious to those skilled in the art.

Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A system for remotely activating a deployed device, the deployed device having a load and a battery, the system comprising:

(a) a transmitter, remote from the deployed device, for generating an AC magnetic field; and (b) a receiver disposed at the deployed device, the receiver including (i) an antenna and a voltage detector coupled to said antenna for sensing the AC magnetic field and generating an output signal in response to the sensed AC magnetic field, wherein said voltage detector only generates said output signal when the sensed AC magnetic field induces a voltage in said antenna and said voltage exceeds a threshold voltage;

(ii) a switch coupled in series with the load and the battery; and (iii) an integrating delay circuit coupled between the voltage detector and said switch for integrating the output signal, said switch being responsive to said integrating delay circuit to couple the battery to the load, thereby activating the deployed device, and wherein said voltage detector includes at least one semiconductor device, said semiconductor device having a cutoff mode and an active mode, and wherein said semiconductor device operates in said cutoff mode when said induced voltage is below the threshold voltage, and operates in said active mode when said induced voltage is above the threshold voltage.

2. The system as claimed in claim 1, wherein the AC magnetic field has a predetermined frequency and the antenna is a tuned antenna tuned to the predetermined frequency.

3. The system as claimed in claim 1, wherein said voltage detector includes a first transistor having its base-emitter junction coupled in parallel with said antenna, and a second transistor having its base coupled to the collector of said first transistor, and wherein the collector of said second transistor is coupled to said integrating delay circuit and provides said output signal.

4. The system as claimed in claim 3, wherein the emitter of said first transistor is coupled to a terminal of the battery and the emitter of said second transistor is coupled to an opposing terminal of the battery.

5. The system as claimed in claim 3, wherein said first transistor is an NPN transistor and said second transistor is a PNP transistor.

6. The system as claimed in claim 3, wherein said first transistor is a PNP transistor and said second transistor is an NPN transistor.

7. The system as claimed in claim 1, wherein said semiconductor device couples the load to the battery when in said active mode, and decouples the load from the battery when in said cutoff mode.

8. The system as claimed in claim 1, wherein said switch is selected from the group including a field effect transistor, a bipolar junction transistor, and a relay.

9. The system as claimed in claim 1, wherein said voltage detector senses the AC magnetic field when said transmitter is up to 100 meters distant from said receiver.

10. The system as claimed in claim 1, wherein said receiver consumes less than 100 nW of power when said switch is open.

11. The system claimed in claim 1, wherein said voltage detector and said switch are configured to draw no bias current from the battery when in a standby mode, and wherein the receiver draws only semiconductor leakage currents from the battery when in said standby mode.

12. The system claimed in claim 1, wherein said voltage detector includes a rectifying transistor and an amplifying transistor, and wherein said transistors are configured to draw no bias current in the absence of said voltage exceeding said threshold voltage.

13. The system claimed in claim 1, wherein said integrating delay circuit comprises a resistor and a capacitor and configured to prevent operation of said switch until said AC magnetic field is received for at least a predetermined duration.

14. A device for remote deployment, having both an active mode and a standby mode, the device switching from the standby mode to the active mode in response to the sensing of an AC magnetic field transmitted from a remote transmitter, the device comprising:

(a) a load;

(b) a battery; and (c) a receiver including (i) an antenna and a voltage detector coupled to said antenna for sensing the AC magnetic field and for generating an output signal in response to the sensed AC magnetic field, wherein said voltage detector only generates said output signal when the sensed AC magnetic field induces a voltage in said antenna and said voltage exceeds a threshold voltage;

(ii) a switch coupled in series with the load and the battery; and (iii) an integrating delay circuit coupled between the voltage detector and said switch for integrating the output signal, said switch being responsive to said integrating delay circuit to couple the battery to the load, thereby activating the deployed device, wherein said voltage detector includes at least one semiconductor device, said semiconductor device having a cutoff mode and an active mode, and wherein said semiconductor device operates in said cutoff mode when said induced voltage is below the threshold voltage, and operates in said active mode when said induced voltage is above the threshold voltage.

15. The device as claimed in claim 14, wherein the AC magnetic field has a predetermined frequency and the antenna is a tuned antenna tuned to the predetermined frequency.

16. The device as claimed in claim 15, wherein the tuned antenna includes an induction coil and a tuning capacitor.

17. The device as claimed in claim 14, wherein said voltage detector includes a first transistor having its base-emitter junction coupled in parallel with said antenna, and a second transistor having its base coupled to the collector of said first transistor, and wherein the collector of said second transistor is coupled to said integrating delay circuit and provides said output signal.

18. The device as claimed in claim 17, wherein the emitter of said first transistor is coupled to a terminal of said battery and the emitter of said second transistor is coupled to an opposing terminal of said battery.

19. The device as claimed in claim 17, wherein said first transistor is an NPN transistor and said second transistor is a PNP transistor.

20. The device as claimed in claim 17, wherein said first transistor is a PNP transistor and said second transistor is an NPN transistor.

21. The device as claimed in claim 14, wherein said semiconductor device couples said load to said battery when in said active mode, and decouples said load from said battery when in said cutoff mode.

22. The device as claimed in claim 14, wherein said switch is selected from the group including a field effect transistor, a bipolar junction transistor, and a relay.

23. The device as claimed in claim 14, wherein said voltage detector senses the AC magnetic field when the transmitter is up to 100 meters distant from said receiver.

24. The device as claimed in claim 14, wherein said receiver consumes less than 100 nW of power when said switch is open.

25. The device claimed in claim 14, wherein said voltage detector and said switch are configured to draw no bias current from the battery when in a standby mode, and wherein the receiver draws only semiconductor leakage currents from the battery when in said standby mode.

26. The device claimed in claim 14, wherein said voltage detector includes a rectifying transistor and an amplifying transistor, and wherein said transistors are configured to draw no bias current in the absence of said voltage exceeding said threshold voltage.

27. The device claimed in claim 14, wherein said integrating delay circuit comprises a resistor and a capacitor and configured to prevent operation of said switch until said AC magnetic field is received for at least a predetermined duration.

28. A deployable device, comprising a load, a battery, and a passive inductive switch for selectively coupling the load to the battery in response to a received AC magnetic field, the passive inductive switch comprising:

a tuned antenna a voltage detector connected across the tuned antenna for receiving and rectifying AC electrical signals induced in the tuned antenna by the AC magnetic field, wherein the voltage detector comprises a first semiconductor junction having at least one terminal connected to the battery and operating in cutoff mode unless said electrical signals exceed a threshold voltage whereupon the voltage detector outputs a rectified AC output;

an integrating delay circuit connected to the voltage detector for receiving the rectified AC output and for integrating the rectified AC output to provide an integrated voltage signal; and a semiconductor switch connected in series between the battery and the load for selectively coupling the load to the battery, and connected to the integrating delay circuit, whereby the switch comprises a normally-open switch configured to connect the load to the battery in response to the integrated voltage signal, wherein the voltage detector and semiconductor switch draw no bias currents from the battery when in a standby mode, and wherein the passive inductive switch draws only semiconductor leakage currents from the battery when in said standby mode.

29. The device as claimed in claim 28, wherein said voltage detector includes a first transistor having its base-emitter junction coupled in parallel with said antenna, and a second transistor having its base coupled to the collector of said first transistor, wherein the collector of said second transistor is coupled to said integrating delay circuit and provides said output signal, and wherein the emitter of said second transistor is connected to a terminal of the battery.

30. The device claimed in claim 29, wherein the base of said first transistor is connected solely to said tuned antenna and remains in said cutoff mode in the absence of said electrical signals exceeding said threshold voltage.

31. The device claimed in claim 30, wherein said second transistor is configured to remain in a cutoff state and adapted to enter an active state when said first transistor enters an active state.

32. The device claimed in claim 29, wherein said integrating delay circuit comprises a first resistor, a second resistor, and a capacitor, wherein said second resistor and said capacitor are connected in parallel, said first resistor is connected between the collector of said second transistor and one terminal of the capacitor, wherein the other terminal of the capacitor is connected to ground, and wherein said integrated voltage signal is output from said one terminal.

33. The device claimed in claim 28, wherein the load comprises activation electronics for a weapon.

* * * * *